United States Patent [19]

Trzeciak

[11] 4,232,751

[45] Nov. 11, 1980

[54] IN-HOLE MOTOR DRILL WITH BIT CLUTCH

[75] Inventor: Kurt H. Trzeciak, Fountain Valley, Calif.

[73] Assignee: Smith International, Inc., Newport Beach, Calif.

[21] Appl. No.: 957,179

[22] Filed: Nov. 2, 1978

[51] Int. Cl.[3] ..... E21B 4/00

[52] U.S. Cl. ..... 175/101; 166/237; 175/107

[58] Field of Search ..... 175/101, 107, 306; 64/4, 15, DIG. 2; 415/502; 166/237

[56] References Cited

U.S. PATENT DOCUMENTS

| | | | |
|---|---|---|---|
| 3,894,818 | 7/1975 | Tschirky | 175/107 X |
| 3,989,409 | 11/1976 | Ioannesian | 175/107 X |
| 4,080,094 | 3/1978 | Jeter | 415/502 X |

FOREIGN PATENT DOCUMENTS

| | | | |
|---|---|---|---|
| 395557 | 11/1973 | U.S.S.R. | 175/101 |

*Primary Examiner*—James A. Leppink
*Assistant Examiner*—Richard E. Favreau
*Attorney, Agent, or Firm*—Philip Subkow; Bernard Kriegel; Newton H. Lee

[57] ABSTRACT

An in-hole motor drill assembly has the rotor of the motor connected to the drill bit by a slidable rotary drive connection, and normally disengaged torque transmitting members are engageable, if desired, to lock the bit and motor housing together for rotation of the bit by rotation of the motor housing. The torque transmitting members also interlock to prevent disengagement when an upward pull is applied during rotation of the bit.

21 Claims, 7 Drawing Figures

IN-HOLE MOTOR DRILL WITH BIT CLUTCH

BACKGROUND OF THE INVENTION

In the drilling of bore holes into or through earth formation, such as, for example, in the drilling of oil or gas wells, utilizing a rotary drill bit, it may occur, from time to time, that the bit may be stuck in the earth formation or debris in the bore hole, either due to the caving in of the bore hole wall, or due to the formation of a key seat in the hard earth formation. When the bit is stuck, under such circumstances, it is difficult, if not impossible, to pull the drill string and bit from the bore hole. In the case of drilling by the usual rotary method, wherein the drill bit is attached to the lower end of a rotary string of drill pipe, it is an easy matter to rotate the drill pipe by the usual rotary table as an upward pull is being applied to the drill pipe, to assist in the release of the stuck bit.

In the case of in-hole motor drill assemblies of the electrical or fluid motor types wherein the rotary drill bit is driven by the in-hole motor interposed between the running string and the bit, it is not, as a rule, possible to cause the bit to rotate by rotation of the running drill or pipe string or fluid conduit above the motor. The reaction torque of such in-hole motors is, generally, taken by a rotary table at the surface of the bore hole, whereby the drill pipe string can either be held stationary or, if desired, rotated to obviate the wedging of the string. However, if the bit becomes stuck in the bore hole, such in-hole motors will stall and continued rotation of the bit may not be possible, notwithstanding the availability of additional drilling fluid pressure. When such motor drills are stalled in the bore hole, rotation of the drill pipe string by the rotary table is ineffective to cause bit rotation, since there is no positive drive between the stator and the rotor and the bit remains wedged, or stuck, in the hole. As a consequence, when an in-hole motor drill has the drill bit stuck in the bore hole, the only recourse has been to attempt to pull the running pipe string and the motor drill from the bore hole, without rotating the bit, and various jarring devices have been utilized in the drill pipe string to assist in applying upward jarring forces to the drill pipe string and to the bit, in an effort to dislodge the latter.

In the event that the bit remains stuck, the only recourse is to break the drill pipe joint above the motor drill assembly, if possible, in a known manner, whereby the drill pipe string can be retrieved to the drilling rig and, thereafter, to sidetrack the bore hole around the motor and bit which remain in the hole. Such practices result in great losses in time and costs.

SUMMARY OF THE INVENTION

The present invention relates to the in-hole motor drill apparatus, wherein the rotor of the motor is connected to the drill bit by a rotary drive connection, including torque transmitting members, which can enable the stator or housing of the motor, in the event that the bit becomes stuck in the hole, to positively transmit torque to the bit, in response to rotation of the drill pipe string.

In specific forms the torque transmitting member interlocks to enable the application of pulling force to the bit as it is rotated by the pipe string.

More particularly, a normally disengaged rotary clutch is provided between the motor housing and the bit and is engaged when weight is applied through the motor housing, by the drill pipe string, in excess of that normally applied during the drilling of the bore hole. In this connection, it will be understood that the progression of the bore hole, as the bit rotates, during normal drilling operations, is dependent upon the thrust or weight applied to the cutting element of the bit through the motor housing, such weight being transmitted to the in-hole motor drive shaft through a bearing which supports the drive shaft within the motor housing for rotation. The clutch contemplated by the present invention is normally disengaged during normal drilling operations, but the construction is one wherein, if the bit becomes stuck in the bore hole, or if positive rotary drive is otherwise necessary, additional weight can be applied to the bit through the motor housing, causing engagement of the clutch between the housing and the bit so that, thereafter, rotation of the drill string can effect rotation of the drill bit, even though the in-hole motor is incapable of causing the bit to rotate.

The clutch, in the specific forms, is a jaw clutch, having jaws which interlock against axial separation, responsive to rotation of the housing, thereby enabling the application of pulling force to the bit.

Means are provided for maintaining the clutch disengaged during normal operation, but permitting the engagement of the lock or clutch when additional weight is applied to the bit. Such means may take various forms, including releasable devices such as shearable members or resiliently deformable or compressible members capable of transmitting sufficient drilling weight to effect normal drilling operations, but enabling movement of the housing relative to the bit to effect engagement of the clutch, when additional drilling weight is applied.

This invention possesses many other advantages, and has other objects which may be made more clearly apparent from a consideration of several forms in which it may be embodied. Such forms are shown in the drawings accompanying and forming part of the present specification. These forms will now be described in detail for the purpose of illustrating the general principles of the invention; but it is to be understood that such detailed description is not to be taken in a limiting sense.

DESCRIPTION OF THE PREFERRED EMBODIMENTS

Figure 1:
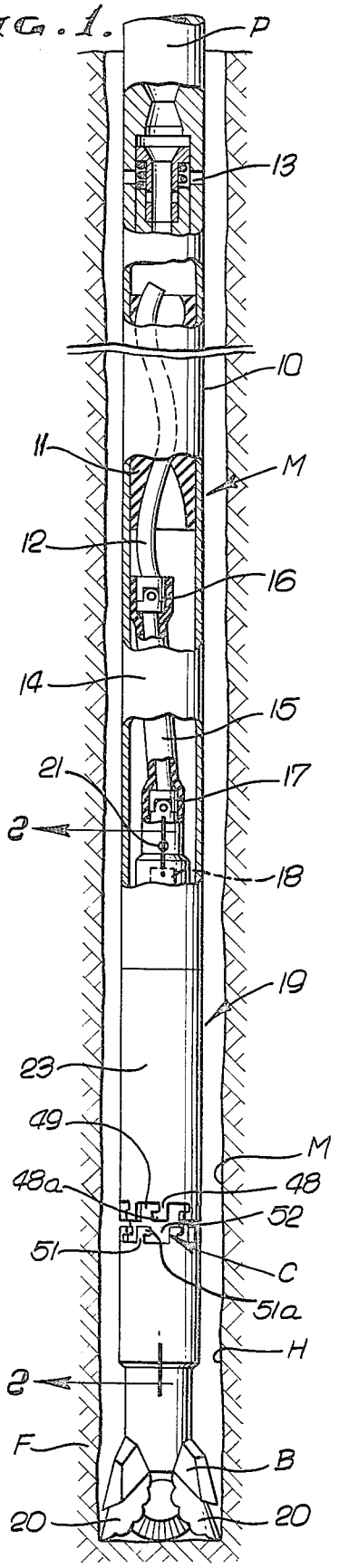
FIG. 1 is a view diagrammatically showing an in-hole motor drill, partly in elevation and partly in section, in an earth bore hole, and incorporating a clutch structure in accordance with the invention.

As seen in the drawings, referring first to FIG. 1, an in-hole motor assembly M is connected to the lower end of a string of drilling fluid conducting drill pipe P and has its housing 10 providing a progressing cavity stator 11 for a rotatable helicoidal rotor 12. The illustrative motor is a positive displacement-type fluid motor of a known type. The rotor is driven by the downward flow of fluid from the pipe string through the usual clump valve 13, the fluid passing downwardly through a connecting rod housing section 14 which contains a connecting rod assembly 15, connected by a universal joint 16 to the lower end of the rotor 12 and by a universal joint 17 to the upper end of the drive shaft 18. The drive shaft extends downwardly through a bearing assembly 19, and at its lower end, the drive shaft is connected to a drill bit B, having cutters 20 adapted to drill through the earth formation F, in the drilling of a bore hole H. The drive shaft 18 is tubular and has, adjacent its upper end, inlet ports 21, through which the drilling fluid passes from the connecting rod housing 14 into the elongated central bore 22 of the drive shaft, the fluid exiting from the bit B to flush cuttings from the bore hole and cool the bit.

Figure 2A:
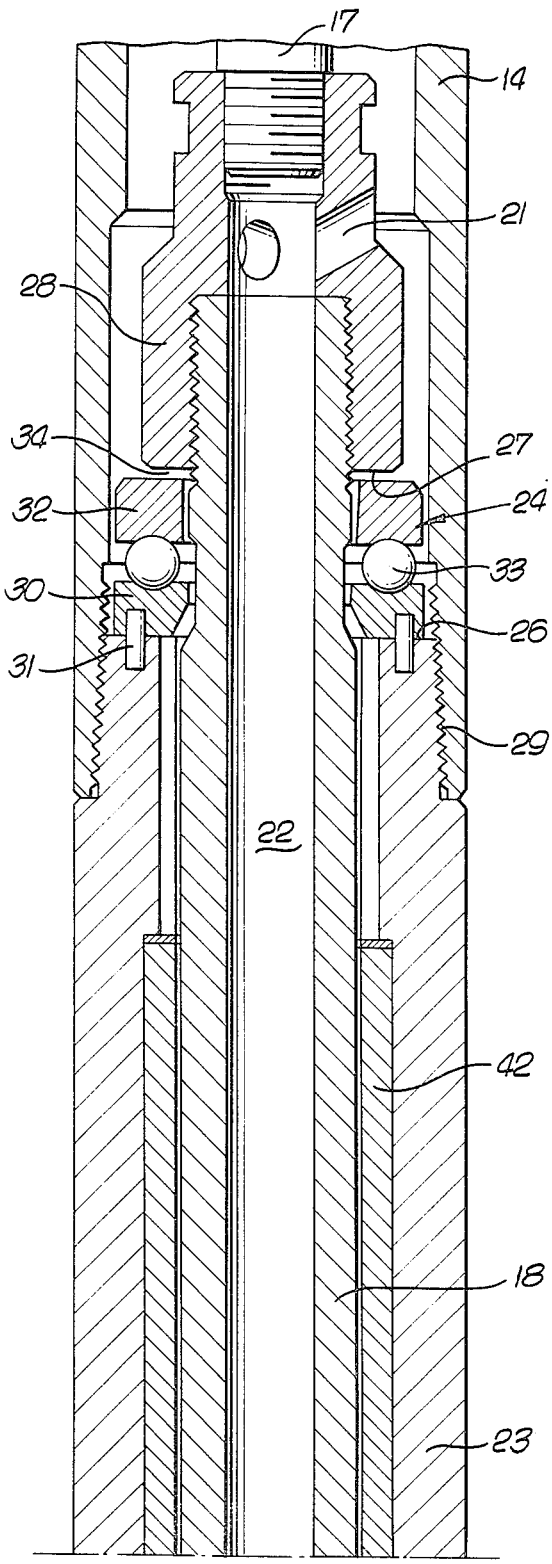
FIGS. 2*a* and 2*b* together, constitute an enlarged longitudinal section, as taken on the line 2—2 of FIG. 1, FIG. 2*b* being a downward continuation of FIG. 2*a*, with the motor drill apparatus in condition for drilling the bore hole in the usual manner.
Figure 2B:
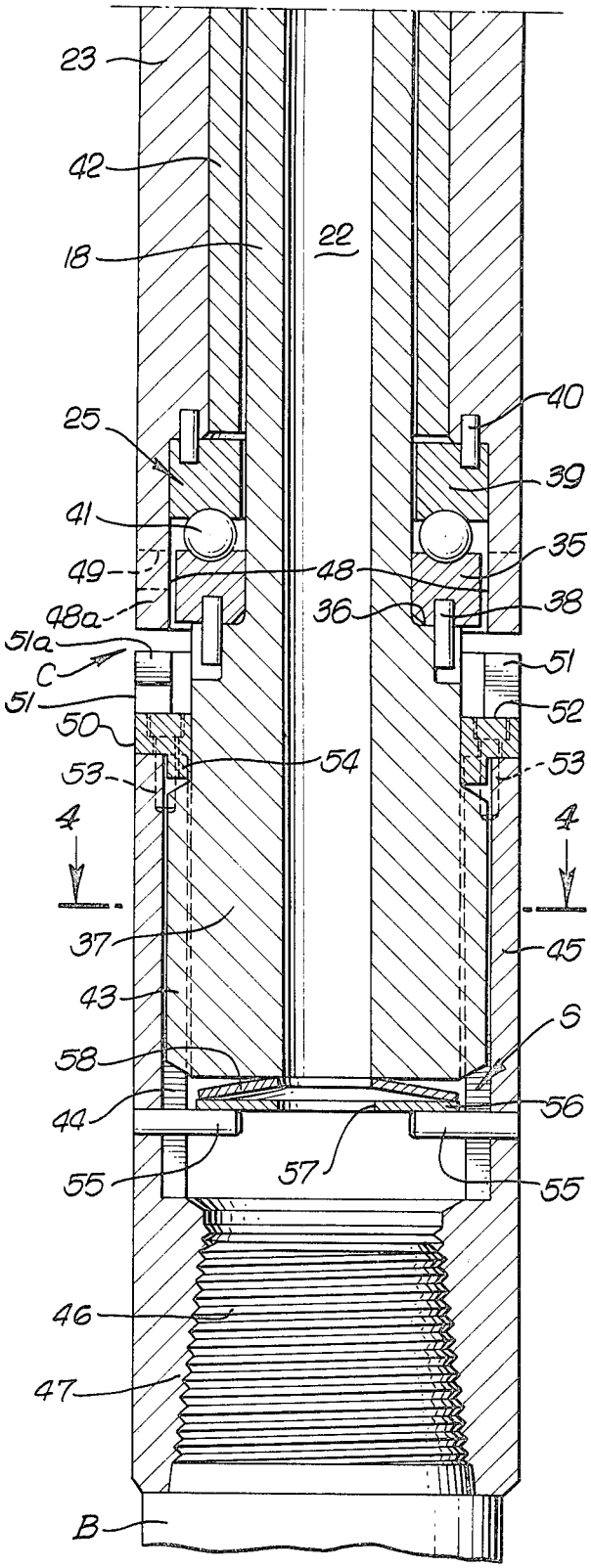

During operation of the fluid motor M, the lower end of the rotor 12 has an eccentric motion which is transmitted to the drive shaft 8 by the universal connecting rod assembly 15, and the drive shaft 18 revolves about a fixed axis within the outer housing structure 23 of the bearing assembly 19, the drive shaft being supported within the housing by bearing means 24 and 25, more particularly illustrated in FIGS. 2*a* and 2*b*.

As seen in FIG. 2*a*, the bearing means 24 constitutes a pick up bearing interposed between the upper end shoulder 26 of the bearing housing 23 and a downwardly facing shoulder 27 provided at the lower end of a connector cap or nut 28 which contains the ports 21 and which connects the universal joint 17 to the upper end of the drive shaft 18. The bearing means 24 is located at a threaded joint 29 between the connecting rod housing 14 and the bearing housing 23. In the illustrated form, the bearing means 24 includes a lower, annular race 30 pinned at 31 to the bearing housing 23, and an upper race 32, bearing balls 33 being disposed between the races. A small vertical clearance space 34 is provided between the lower end 27 of the connector cap 28 and the upper bearing race 32, when the apparatus is in the condition of FIG. 2*a*, so that when the motor drill is being operated to cause the drilling of the bore hole, the pickup bearing balls and races are not loaded, as is well known.

The lower bearing means 25, as seen in FIG. 2*b*, includes a lower bearing race 35 seating on an upwardly facing shoulder 36 provided on an enlarged lower end 37 of the drive shaft 18 and pinned or keyed thereto as at 38, so as to rotate with the shaft. Above the lower race 35 is an upper bearing race 39 pinned or keyed at 40 to the bearing housing 23, and a suitable number of bearing balls 41 are disposed between the races 35 and 39 to transmit axial thrust or load from the housing to the shoulder 36 of the drive shaft.

Between the upper bearing 24 and the lower bearing 25 is an elongated flow restrictor sleeve 42, which also may function as a radial bearing, if desired, whereby the bypass of the drilling fluid through the bearing assembly, to cool and lubricate the bearings can be restricted so that the majority of the drilling fluid, passing downwardly through the connecting rod housing 14, will flow through the ports 21, downwardly through the drive shaft bore 22, exiting into the bore hole through the bit B, as is well known.

The bearing means illustrated and described above are typical in motors of the type here involved, and if desired, the bearing means may take various other forms, including plural stacked bearings or sealed bearing assemblies, also known in the prior art.

Figure 3:
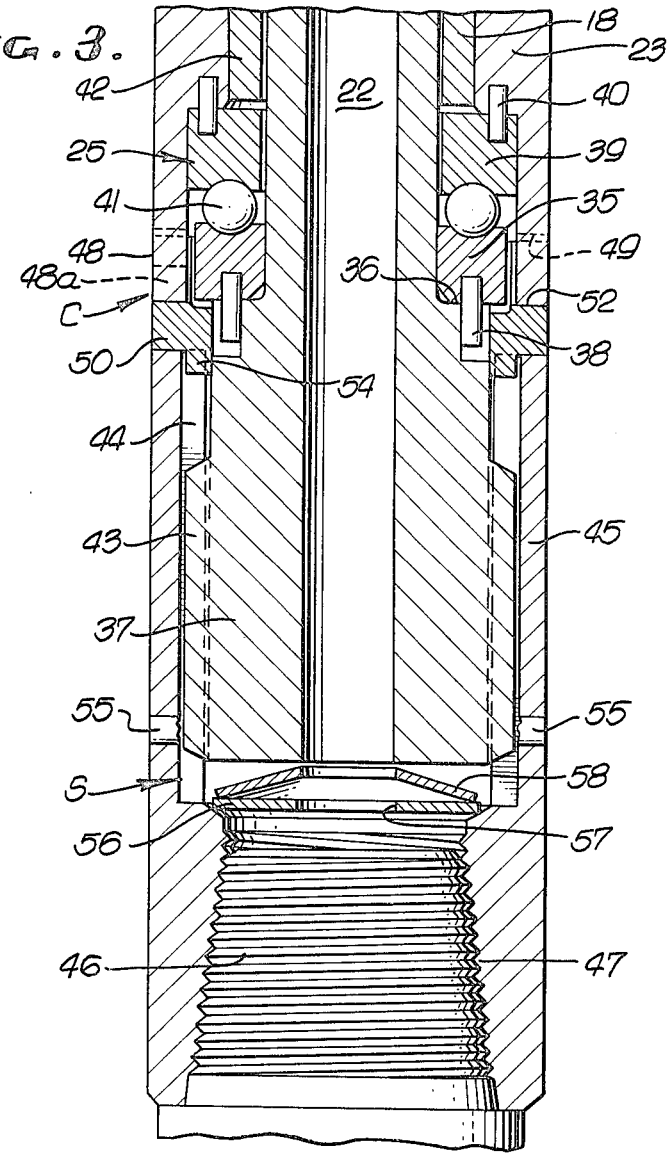
FIG. 3 is a fragmentary longitudinal section, generally corresponding to FIG. 2*b*, but showing the clutch engaged in response to the application of the additional weight to the bit.
Figure 4:
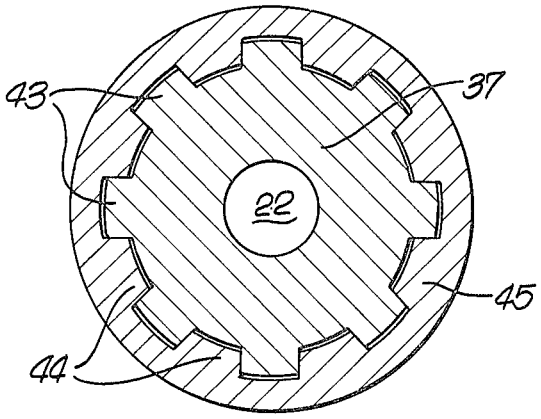
FIG. 4 is a transverse section, as taken on the line 4—4 of FIG. 2*b*, illustrating the rotary drive connection between the motor drive shaft and the bit sub.

The present invention is more particularly concerned with the provision of clutch means C, generally shown in FIG. 1, and more particularly seen in FIGS. 2*b* and 3, in the embodiment now being described.

In the preferred embodiments, shown herein, the lower enlarged end 37 of the drive shaft 18 has a plurality of circumferentially spaced longitudinally extended ribs or splines 43 engageable with and slideable with respect to a plurality of longitudinally extended and circumferentially spaced internal ribs or splines 44 within a tubular bit sub or body 45. The bit B has, at its upper end, a threaded pin 46 engageable within the lower, internally threaded box 47 on the bit sub 45. Accordingly, rotation of the rotary drive shaft 18 is transmitted through the bit sub 45, and, thus, to the bit B, through the slideably interengaged ribs or splines 43 and 44.

The clutch means, in the embodiments illustrated herein includes torque transmitting members incorporated in a typical jaw clutch construction. Other clutches may be employed which can transmit torque to the bit by rotation of the housing. The lower end of the bearing housing 23 has a number of circumferentially spaced axially extended lugs 48 and intervening circumferentially spaced notches or recesses 49, and, at the upper end of the bit sub 45, is a clutch ring member 50 which has a number of circumferentially spaced axially extended lugs 51 and intervening notches 52 companion to the lugs and notches 48 and 49 on the lower end of the bearing housing. The end of the housing and the ring 50 on the upper end of the bit are normally held in the condition shown in FIG. 2*b*, at which the lugs 48 and 51 are longitudinally displaced or clear of coengagement, so that rotation of the drive shaft relative to the bearing housing can occur, by means S which are operable as will be later described to permit the clutch jaws or lugs 48 and 51 to be engaged in response to relative longitudinal movement of the bearing housing and bit sub.

In the preferred form the clutch is constructed to enable upward pull on the drill pipe to be applied to the bit, while the pipe and bit are rotated. Thus, the lugs 48 and 52 are complementally formed for axially interlocking engagement responsive to rotation of the drill pipe. The respective lugs 48 and 51 have heads or lugs 48*a* and 51*a*, respectively, coengageable at axially confronting surfaces to interlock the housing to the bit sub.

As previously indicated, the clutch lugs 51 are provided on a ring 50 at the upper end of the bit sub 45. This ring 50 is secured to the upper end of the bit sub by a suitable number of circumferentially spaced screw fasteners 53, so that the internal spline 44 can be formed within the bit sub, and the means S, to be later described, can be assembled within the bit sub, between the lower end of the drive shaft and the bit sub. This ring 50 has a suitable plurality of circumferentially spaced, downwardly extended lugs 54 which extend into companion notches or recesses within the bit sub body, so that, when the clutch means C is engaged, torque is transmitted through the lugs 54 to the bit sub 45, rather than through the screw fasteners 53. The ring 50 also captures the ribs or splines 43 of the drive shaft 18 within the bit sub, so that the bit sub and bit are retained upon the lower end of the drive shaft, upon upward movement of the drilling assembly within the bore hole.

The means S for normally holding the clutch means C disengaged, in the condition of FIG. 2*b*, but enabling relative longitudinal movement of the bit sub and bearing housing, to effect engagement of the clutch means, may take various forms, such as shearable means, including a suitable number of shear pins 55 installed in the bit sub 45 and projecting radially inwardly in circumferentially spaced relation beneath the lower end of the enlarged section 37 of the drive shaft 18. Disposed upon the shear pins 55 is a shear ring 56 having a central flow passage 57, and above the ring 56 is a shock absorber spring 58, in the form of a Belleville spring, which engages at its outer periphery with the underside of the drive shaft 18. If desired, a plurality of springs, such as the springs 58 may be employed in stacked relationship.

It will now be apparent that downward thrust or drilling thrust or weight is transferred from the bearing housing 23, through the bearing assembly 25, to the drive shaft 18, and then to the spring 58, and from the spring 58 to the shear pins 55, and, since the shear pins 55 are carried by the bit sub 45, the drilling thrust or weight is transferred from the bearing housing 23 to the bit B through the shear pins 55. The spring or springs 58 serve to cushion the shock or vibration occurring during the drilling operation. It will be understood however, that in other known bearing assemblies, vibration damping or shock absorbing springs may be incorporated in the bearing assemblies, in which case a spring, such as the spring 58 would not normally be employed.

In the use of the apparatus, as thus far described, the motor drill structure is run into the bore hole on the drill pipe, and drilling fluid is displaced downwardly through the drill pipe, entering the drive shaft passage 22 and exiting from the bit, to flush cuttings from the bore hole, as the drilling progresses, in response to rotation of the drive shaft 18 by the flow of drilling through the stator of the motor, with resultant rotation of the drive shaft, and the rate at which the drilling progresses is determined by the weight applied to the cutting elements through the drill pipe string, the bearing housing, and the set down bearing 25, which applies axial thrust to the drive shaft 18 and, thence, through the shear pins 55 to the bit sub 45 and the bit B. In the event that the bit should become, for one reason or another, stuck in the bore hole, the motor M may be caused to stall, since the available torque output from the motor cannot overcome the resistence to turning of the bit. Under these circumstances, if the bit becomes stuck, retrieval of the drill string motor and pipe may be very difficult. Since, in part, the difficulty in removal of the drill string motor and bit may be caused by the fact that the bit itself is stuck in the bore hole, and cannot be rotated, the present invention, through the clutch means C enables the bit to be positively rotated by rotation of the drill pipe string by the usual rotary table at the top of the well bore. When it appears that the bit is stuck, the weight applied to the bit, through the drill string, is increased by lowering more of the drill string weight downwardly upon the bit from the usual derrick, causing the shear pins 55 to be sheared, as shown in FIG. 3. At this time, the housing 23 and the drive shaft can move downwardly with respect to the bit sub 45, causing the lugs 48 and 51 on the housing and the bit sub to be coengaged. Thereupon, rotation can be transmitted from the rotary table to the drill pipe string, and thus to the bit sub and bit, directly through the clutch means C, independently of the ability of the motor M to cause rotation. Upward pull on the drill pipe string can be applied following bit rotation, and the clutch means being constructed to provide an interlock, thereby enhances the possibility of retrieval of the bit from the bore hole since upward pull can be applied. The bit sub and bit are held against displacement from the lower end of the drive shaft by the upper retainer ring 50, described above.

Figure 5:
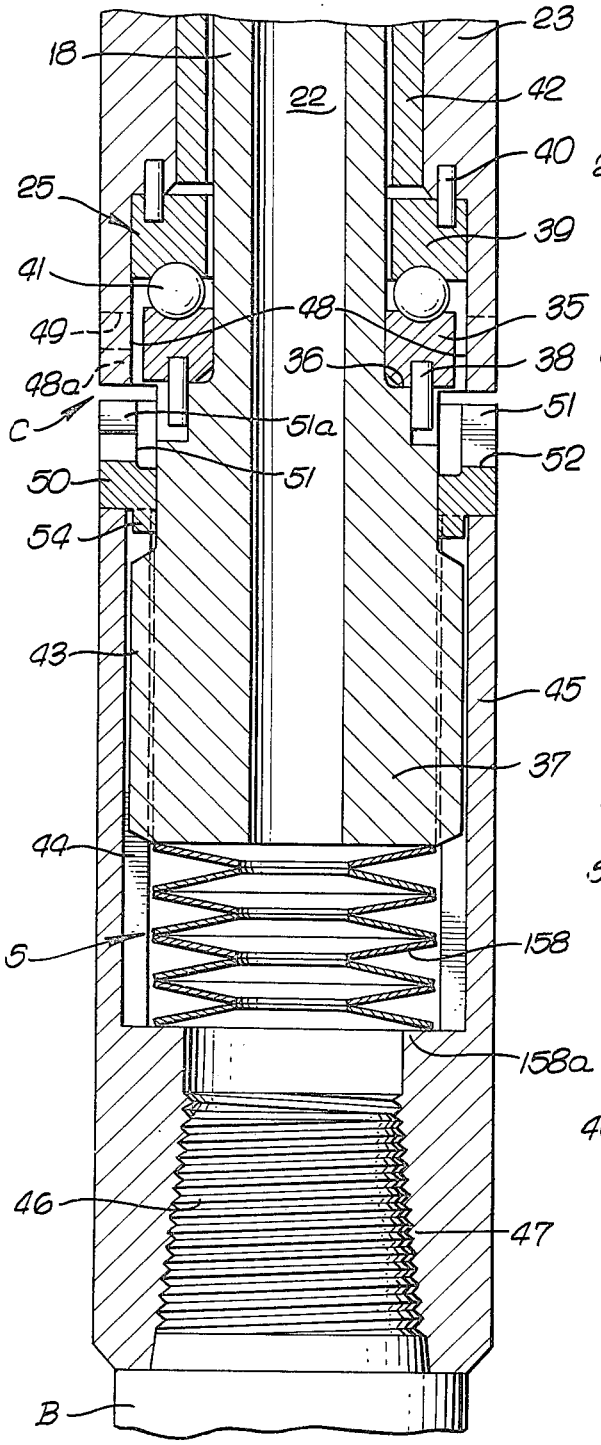
FIG. 5 is a view generally corresponding to FIG. 2*b*, but showing a modified form of the invention, with the motor drill apparatus in condition for normal drilling operations.
Figure 6:
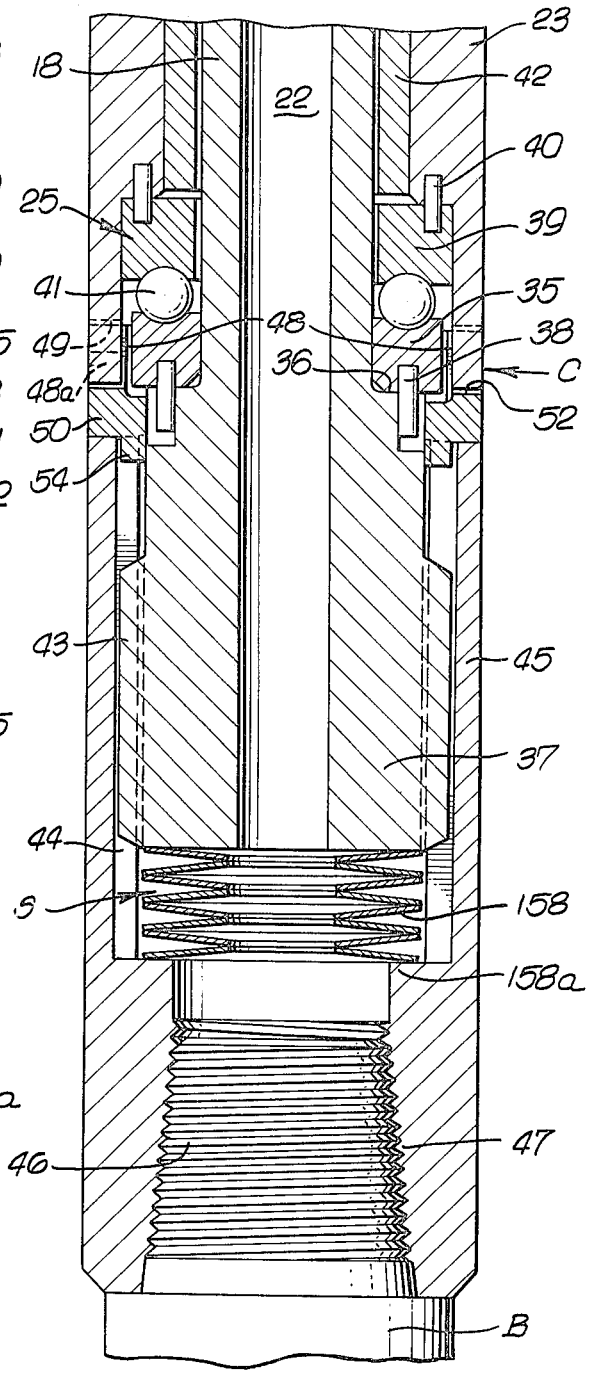
FIG. 6 is a view corresponding to FIG. 5, but showing the clutch engaged in response to the application of additional weight to the bit.

Refering to FIGS. 5 and 6 another embodiment of the invention is illustrated, wherein the exemplary bearing assembly is the same as that previously described, and wherein the lower end of the drive shaft is drivingly connected with the bit sub in the same manner described above. However in this form, the means S, whereby weight is transmitted to the bit during the normal drilling operations, but additional weight enables engagement of the lock or clutch means C, is in the form of a resiliently deformable structure. The resiliently deformable structure S, as seen in FIG. 5, comprises spring means, including, in the specific form illustrated, a stack of Belleville springs or washers 158, alternately arranged, with the lowermost spring seating upon an internal seat 158*a* provided within the lower end of the bit sub, and the uppermost spring seating against the lower end of the drive shaft end 37. Other spring means may be employed. However, the illustrated Belleville springs have a substantially constant spring rate. Accordingly, it is possible to select a suitable number of Belleville springs of the desired characteristic to transmit therethrough a selected drilling weight, say 25,000 pounds, with resultant relatively small deflection in the spring elements. However, upon the application of weight in excess of the 25,000 pounds, the deflection of the Belleville springs enables the housing and drive shaft to move downwardly, to effect coengagement of the clutch elements on the housing and on the bit sub.

From the foregoing, it will now be apparent that the present invention provides a simple, yet effective solution to the problem of enabling positive rotation of a drill bit which is normally driven by a fluid driven motor, in the event that the bit becomes stuck, by providing a rotary driving connection between the motor drive shaft and the bit, together with a clutch or rotary locking device which can be engaged in response to the application of weight to the bit, in excess of that normally used during the drilling operations.

I claim:

1. An in-hole motor comprising: an elongated motor stator including a housing connectable at one end to a pipe string; a rotor in said stator; a drive shaft extending from the other end of said housing and connected with said rotor for rotation therewith relative to said housing; a drill bit connector to mount a drill bit on said drive shaft for rotation therewith relative to said housing; bearings between said shaft and said housing to transmit thrust from said housing to said shaft in opposite directions to load said bit axially against the bottom of a bore hole and to pull said bit off the bottom of the bore hole; normally disengaged clutch means engageable between said housing and said shaft for coupling said shaft and housing for rotation together.

2. An in-hole motor drill as defined in claim 1; including means to interlock said bit and said housing to transmit upward pull to said bit from said housing.

3. An in-hole motor drill as defined in claim 1; said normally disengaged clutch means comprising means normally preventing engagement of said clutch.

4. An in-hole motor drill as defined in claim 3; said means normally preventing engagement of said clutch including means for transmitting thrust to said bit from said housing and operable upon the application of a predetermined thrust load from said housing to allow longitudinal motion of said housing to engage said clutch means, said clutch means having torque transmitting member coengageable to lock said clutch against release upon rotation of said housing.

5. An in-hole motor drill as defined in claim 3; said means normally preventing engagement of said clutch including means for transmitting thrust to said bit from said housing.

6. An in-hole motor drill as defined in claim 3; said means normally preventing engagement of said clutch including means for transmitting thrust to said bit from said housing and operable upon the application of a predetermined thrust load from said housing to allow longitudinal motion of said housing to engage said clutch means.

7. An in-hole motor drill as defined in claim 3; said means normally preventing engagement of said clutch including means for transmitting thrust to said bit from said housing and resiliently deformable upon the application of a predetermined thrust load from said housing to allow longitudinal motion of said housing to engage said clutch means.

8. An in-hole motor drill as defined in claim 3; said means normally preventing engagement of said clutch including means for transmitting thrust to said bit from said housing and shearable upon the application of a predetermined thrust load from said housing to allow longitudinal motion of said housing to engage said clutch means.

9. An in-hole motor drill as defined in any of claims 5, 6, 7 or 8; said means normally preventing engagement of said clutch including a shearable member between said bit and said drive shaft; and including a rotary drive connection between said bit and said drive shaft enabling longitudinal motion of said housing to engage said clutch means.

10. An in-hole motor drill as defined in any of claims 5 through 6, said means normally preventing engagement of said clutch, including resilient means between said bit and said drive shaft; and including a rotary drive connection between said bit and said drive shaft enabling longitudinal motion of said housing to engage said clutch means.

11. An in-hole motor drill comprising: an elongated motor stator including a housing connectable at one end to a pipe string; a rotor in said stator; a drive shaft having an end extending from the other end of said housing and connected with said rotor for rotation therewith relative to said housing by the flow of drilling fluid through said housing; a bit sub on said end of said drive shaft; a rotary drive connection between said bit sub and said drive shaft end permitting longitudinal movement of said bit sub on said drive shaft end; clutch means on said bit sub and said housing engageable to transmit rotation from said housing to said bit upon longitudinal relative movement of said housing and said bit sub; and means for transmitting thrust from said drive shaft to said bit sub and operable to permit said longitudinal movement when the thrust load is in excess of a selected load.

12. An in-hole motor drill as defined in claim 11; said thrust transmitting means being shearable when the thrust exceeds said selected load.

13. An in-hole motor drill as defined in claim 11; said thrust transmitting means being resilient.

14. An in-hole motor drill as defined in claim 11; said rotary drive connection including coengaged splines on said bit sub and said drive shaft.

15. An in-hole motor drill as defined in claim 11; said clutch means comprising complemental lugs on said bit sub and said housing.

16. An in-hole motor drill as defined in claim 11; said clutch means comprising complemental lugs on said bit sub and said housing; said lugs having parts coengageable upon rotation of said housing relative to said bit sub to lock said housing and bit sub against opposite longitudinal movement.

17. An in-hole motor assembly adapted for connection with a rotatable pipe string and to drive a drill bit, said assembly comprising: a motor stator including a housing connectable at one end to a pipe string; a rotor in said stator; a drive shaft extending from the other end of said housing and connected to said rotor for rotation therewith relative to said housing; a bit connection on said drive shaft for rotation therewith; thrust transmitting means between said housing and said shaft for transmitting thrust in both axial directions, a clutch between said housing and shaft and engageable for connecting said housing and shaft for joint rotation.

18. An in-hole motor assembly as defined in claim 17; said clutch including members locking said clutch engaged to transmit thrust.

19. An in-hole motor assembly as defined in claim 17; said motor being a fluid driven motor.

20. An in-hole motor assembly as defined in claim 17; said clutch being engageable in response to longitudinal movement of said housing relative to said bit connection.

21. An in-hole motor assembly as defined in claim 20; including a spring resisting said longitudinal movement.

* * * * *